US005174664A

United States Patent [19]

Gugel et al.

[11] Patent Number: 5,174,664

[45] Date of Patent: Dec. 29, 1992

[54] ARMATURE WITH ANGLED BORE FOR PRINT NEEDLE FASTENING

[75] Inventors: Bernd Gugel, Ulm-Einsingen; Horst Heisele, Asselfingen; Herbert Kitzberger, Niederstotzingen, all of Fed. Rep. of Germany

[73] Assignee: Mannesmann AC., Fed. Rep. of Germany

[21] Appl. No.: 742,182

[22] Filed: Aug. 2, 1991

Related U.S. Application Data

[63] Continuation of Ser. No. 523,850, May 16, 1990, abandoned, which is a continuation of Ser. No. 401,534, Aug. 30, 1989, abandoned, which is a continuation-in-part of Ser. No. 822,873, Jan. 27, 1986, abandoned.

[30] Foreign Application Priority Data

Jan. 25, 1985 [DE] Fed. Rep. of Germany ..... 3502471

[51] Int. Cl.[5] ..... B41J 2/26

[52] U.S. Cl. ..... 400/124; 101/93.05

[58] Field of Search ..... 400/124, 124 WD; 101/93.05

[56] References Cited

U.S. PATENT DOCUMENTS

| | | | |
|---|---|---|---|
| 4,136,978 | 1/1979 | Bellinger | 400/124 |
| 4,248,540 | 2/1981 | Bellinger | 400/124 |
| 4,394,093 | 7/1983 | Asano et al. | 400/124 |
| 4,403,875 | 9/1983 | Asano | 400/124 |
| 4,457,635 | 7/1984 | Takezawa et al. | 400/124 |
| 4,544,288 | 10/1985 | Suzuki et al. | 400/124 WD |
| 4,552,064 | 11/1985 | Sanders | 400/124 X |
| 4,555,192 | 11/1985 | Ochiai | 400/124 |
| 4,569,604 | 2/1986 | Adachi | 400/124 |
| 4,572,681 | 2/1986 | Miyazawa | 400/124 |
| 4,974,975 | 12/1990 | Andou et al. | 400/124 WD |

FOREIGN PATENT DOCUMENTS

| | | | |
|---|---|---|---|
| 188672 | 7/1986 | European Pat. Off. | 400/124 |
| 201671 | 12/1982 | Fed. Rep. of Germany | 400/124 |
| 3502471 | 7/1986 | Fed. Rep. of Germany WD | 400/124 |
| 84869 | 5/1982 | Japan | 400/124 |
| 49275 | 3/1983 | Japan | 101/93.05 |
| 85773 | 5/1984 | Japan | 400/124 |
| 291150 | 12/1986 | Japan | 400/124 WD |

*Primary Examiner*—David A. Wiecking
*Attorney, Agent, or Firm*—R. H. Siegemund

[57] ABSTRACT

A matrix printhead having a plurality of electromagnetic drives arranged in a cluster including a plurality of drive elements further having a plurality of reciprocating print needles, wires or styli, includes additionally a fastening structure for each of these needles, wires or styli to the drive elements in that the drive element has a width dimension which is larger than a diameter or a representative diameter dimension for the print needle, wire or stylus so as to accomodate an opening in the fastening area having said width and having a cross sectional contour which matches at least in parts the contour of the periphery of the needle to be inserted, there may be an extra slot and the needle as inserted is brazed or soldered to a opening. The opening is at an angle of between 40 and 60 degrees to the plane of the armature.

2 Claims, 4 Drawing Sheets

ARMATURE WITH ANGLED BORE FOR PRINT NEEDLE FASTENING

This is a continuation-in-part of co-pending application Ser. No. 523,850 filed on May 16, 1990, now abandoned, which is a continuation-in-part of Ser. No. 401,534, Aug. 30, 1989 now abandoned which is a continuation of Ser. No. 822,873, filed Jan. 27, 1986, now abandoned.

BACKGROUND OF THE INVENTION

The present invention relates to a matrix printhead which includes a plurality of separately operable and positionable magnetic drives respectively for reciprocating print needles, wires or styli fastened to these drives.

Matrix printheads of the type to which the invention pertains are basically constructed for serial operation or as line printers. In each instance operation has as its principal goal to provide as many print dots as possible, both from the point of view of dots per unit time as well as from the point of view of overall use life. Serial matrix printers at the present time reach a performance rate of about 400 characters per second and line printers even go up to 900 characters/sec. Commensurately with these performances the matrix printers must be expected to respond to the thermal load resulting from densely clustering of the electromagnetic drives as well as to the mechanical wear resulting from high speed mechanical motions. These are important factors to be considered upon making a choice of the type and brand of printers. Aside from problems that may arise in the electric or electronic part of such a printer certain mechanical problems are to be expected. This includes for example the fastening of a print element such as a needle, wire or stylus to the respective drive. This fastening pint is so to speak a weak point within the system.

Basically two modes of fastening a print needle to its drive are known. In accordance with the first mode or type one uses the principle of transmitting movement from the magnetic drive element to the wire or stylus but not directly; rather preferred is a kinematic coupling between these elements through a force locking connection between the drive element such as a pivot armature and a physically separate print needle to which is fastened a head and it is that head which engages the particular drive element i.e. the pivot armature. The engagement should be a positive one. It has to be observed however that wire and wire head on one hand and pivot armature on the other hand have different masses. Therefore the adaptation of that mechanical system to the operating frequency of the magnetic drive is difficult; in particular, problems of parasytic oscillations and of control generally are to be expected. U.S. Pat. No. 4,478,528 is an example of this type of coupling and it is also representative of the type of structure in which the aforementioned problems arrive.

The second type or mode of coupling the first stylus or wire to its drive element avoids in principle the problems above in that the wire or styli are immediately and directly rigidly connected to some front end of the magnetic drive. This means that the needle necessarily follows the control of the drive element and its electronics. German printed patent application 2,630,931 (see U.S. patent application Ser. No. 621,526, filed Oct. 10, 1975) discloses an example of this type. However, from the point of view of manufacturing this type of drive and coupling is realizable only with difficulty. Fastening of the needle or stylus to the armature requires particular auxiliary structures whereby still the danger arises that tolerances of these assisting equipment permit only an inadequate and insufficient arrangement and orientation of the needles or wires vis-a-vis the drive element.

Another drawback of the latter known mode of fastening is to be seen in the connection proper. This connection can be done through soldering but in operation the connecting point is exposed to heat as it is developed in the drive. Heating of the needles which have been soldered, e.g. by inductive method, may in fact in extreme cases lead to fracture of the needle even after a relatively short period of operation. The cause is to be seen in microstructure changes of the material of the needles right at or near the soldering point, ether during the heating on soldering or during subsequent cooling from this soldering process. The reheating during operation will cause very soon fracture.

DESCRIPTION OF THE INVENTION

It is an object of the present invention to improve matrix printers of the type referred to above with particular emphasis on improving the fastening between a print element such as a stylus, wire or needle, to the respective drive. The improvement is directed particularly to the strengthening of this connection.

In accordance with the preferred embodiment of the present invention it is suggested to provide a fastening zone in the magnetic drive element such that within that zone of fastening the element has a width at least equal to (possibly twice or more than) the thickness of the wire, stylus or needle to be fastened and an opening is provided in that fastening zone particularly centrally or symmetrically as far as the magnetic drive element is concerned and having a basic cross section which corresponds at least in parts so the contour of the inserted needle, stylus or wire under consideration of certain manufacturing tolerances. The minimum width of the magnetic drive element as stated ensures that such an opening can in fact be provided for. The opening itself guarantees minimum expenditure and effort for positioning the needle etc. The accuracy of the position is the specific aspect to be considered. Moreover the needle etc. will not be weakened during heating particularly as far as the strength of the material is concerned because the drive elements surrounding that needle ensures fairly slow heat flow out of the solder area.

In furthermore of the invention it is suggested to provide the particular opening or perforation as a circular bore drilled by means of a laser and having a diameter within the range from 0.2 mm to 0.4 mm. The position of the respective print needle is then exclusively determined as to its accuracy by that particular bore and its dimension. This feature in conjunction with the earlier ones ensures that the needle can be soldered right in the opening.

Another improvement pursuant to the invention is to be seen in that the axis of this opening runs obliquely to the surface plane of the magnetic drive element. This feature serves towards providing a "soft" and smooth transition from that fastening point being outside the center axis of the print head, and in the direction towards the mouth piece wherein the tips of the print needles arranged above each other and in one or two columns. That feature is particularly of advantage whenever the needles are comparatively long. Another improvement is to be seen in that the opening in the drive element is configured as a frontal or laterally running slot having a width corresponding to the widths of a needle being inserted either from the front or laterally thereto under consideration of possible and conceivable manufacturing tolerances for the slot and the dimensions of the needle. The needle can be introduced rather easily from the side which is simpler as compared with an axial insertion into a closed round bore. The final fixing of the needle in this case is carried out by filling the slot with solder material.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding to the detailed description of the drawings, FIGS. 1 and 2 illustrate the structure and function of a serial matrix print head as an example for practicing the preferred embodiment of the present invention. Herein practically the cooperation of an armature group or assembly with other groups or assemblies of elements is depicted and illustrated including features for the overall cooperation within the matrix printhead as a whole. The manufacturing process of the various armature parts will be described in details later on. The armature assembly as such is the subject of copending applications Ser. No. 822,867, filed Jan. 27, 1986, now U.S. Pat. No. 4,674.179; Ser. No. 822,874, filed Jan. 27, 1986, now U.S. Pat. No. 4,695,174.

Figure 1:
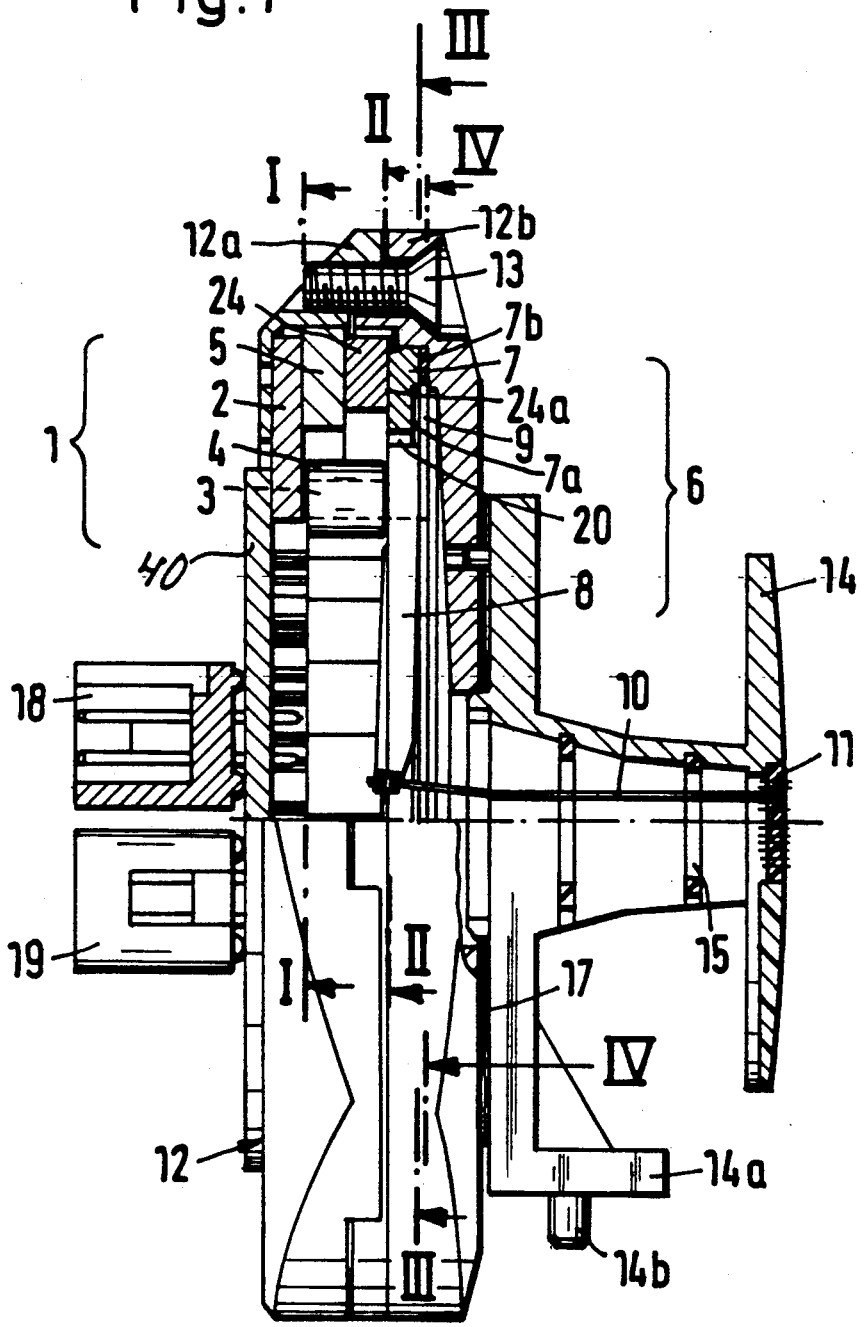
FIG. 1 is a partial section, partial side elevation through a matrix print head in accordance with the preferred embodiment of the present invention for practicing the best mode thereof.

Proceeding to further details the serial matrix printhead as illustrated includes an assembly or group of elements 1 being comprised of a plurality of electromagnetic drives with coils. The drives include a common basic plate or disk 2 for conducting magnetic field into and towards the magnetic wires of the individual drives. A plurality of magnetic pole defining cores 3 are fastened to this plate 2. Each of these cores carries an electromagnetic coil 4. The arrangement is completed by a common permanent magnetic disc, ring or annulus 5. This group or assembly 1 faces another group or assembly 6 being comprised of a plurality of armatures. This armature assembly includes an armature ring 7 with radially inwardly extending deflectable armature arms 8; the deflection can occur to the left or to the right as per FIG. 1. The armature arms 8 are not connected directly to the ring 7 but by means of relatively short spring arms 9. The arms 8 themselves are more or less rigid, resiliency i.e. spring action is provided by the spring arms 9.

All driven parts are mounted inside a casing 12 which does not conduct any magnetic field nor an electric current. The casing or housing 12 is comprised of two parts 12*a* and 12*b* which are fastened together by means of screws or bolts 13 distributed around the periphery of this casing arrangement.

The number of magnetic cores 3, of coils 4, of arms 8 and spring arms 9 correspond to the number of print elements 10 which in this case are comprised of relatively long print needles, wires or styli. The front ends of these needles, wires or styli are all mounted in a mouth piece 11 so that the tips of these needles etc. establish one or two columns; a single column is depicted in the plane of the drawing of FIG. 1. In the present case it is assumed that the total number of print elements is comprised of 24 such elements.

The elements 10 are guided for movement along a print bath being from 0.3 to 0.6 mm long which amounts essentially to an axial movement of these elements within a housing 14 containing slide bearings or mounts 15 for supporting the needles appropriately. The mouthpiece 11 is a part of that housing. Shim elements 17 are interposed between casing or housing 12 on one hand and housing or casing 14 on the other hand in order to adjust very accurately the length of projection of the print elements 10 beyond the housing 14 (mouthpiece 11). The shims 17 permit adjustment of that relative disposition which basically amounts to an adjustment of the spacing of the mouthpiece 11 from relevant drive parts of and in the housing 12. The casing 14 serves also as fastening element for fastening the matrix printhead as a while to a slide carriage or the like (not shown) by means of which the print head is moved along the printing platen. The platen is likewise not shown. These parts are conventional. Illustrated however is a mounting flange 14*a* with indexing pins 14*b*, by means of which the illustrated arrangement can be fastened to the carriage.

Electric current is fed to the respective coils 4 by means of a flexible connection leading to and including a printed circuit board 40 and connections 18 and 19. The connections lead to a symbol generator and circuit by means of which selectivity of energization of the individual needles and print styli is determined.

A noncritical parasitic air gap 20 is provided whose dimensions are chosen so that for deviations of the magnetic flux density and therefore of the energy transmission will not be interred with though such interference could occur in principle. Also the buildup or decay of the electromagnetic fields as superimposed upon the field provided by the permanent magnet, could be interfered with by this air gap 20. However, the gap 20 is made non critical by optimizing magnetization in the gap, i.e. when the gap is selected such that on one hand tight tolerances for manufacturing the ring 7 and the arms 8 are not required while the field density is sufficiently high in order to compensate and balance the resilient bias of this spring arm 9. On the other hand the gap should not be so large as to interfere with the rapid decay of the permanent magnetic field whenever one or the other electromagnetic coils 4 has been switched on and current tends to flow therein. This ideal case can actually be realized by means of the arrangement as also disclosed in the above mentioned copending applications Ser. No. 822,867, filed Jan. 27, 1986, now U.S. Pat. No. 4,674,179, Ser. No. 822,874, filed Jan. 27, 1986, now U.S. Pat. No. 4,695,174 and further including an inventive fastening arrangement as will be described next.

Figure 2:
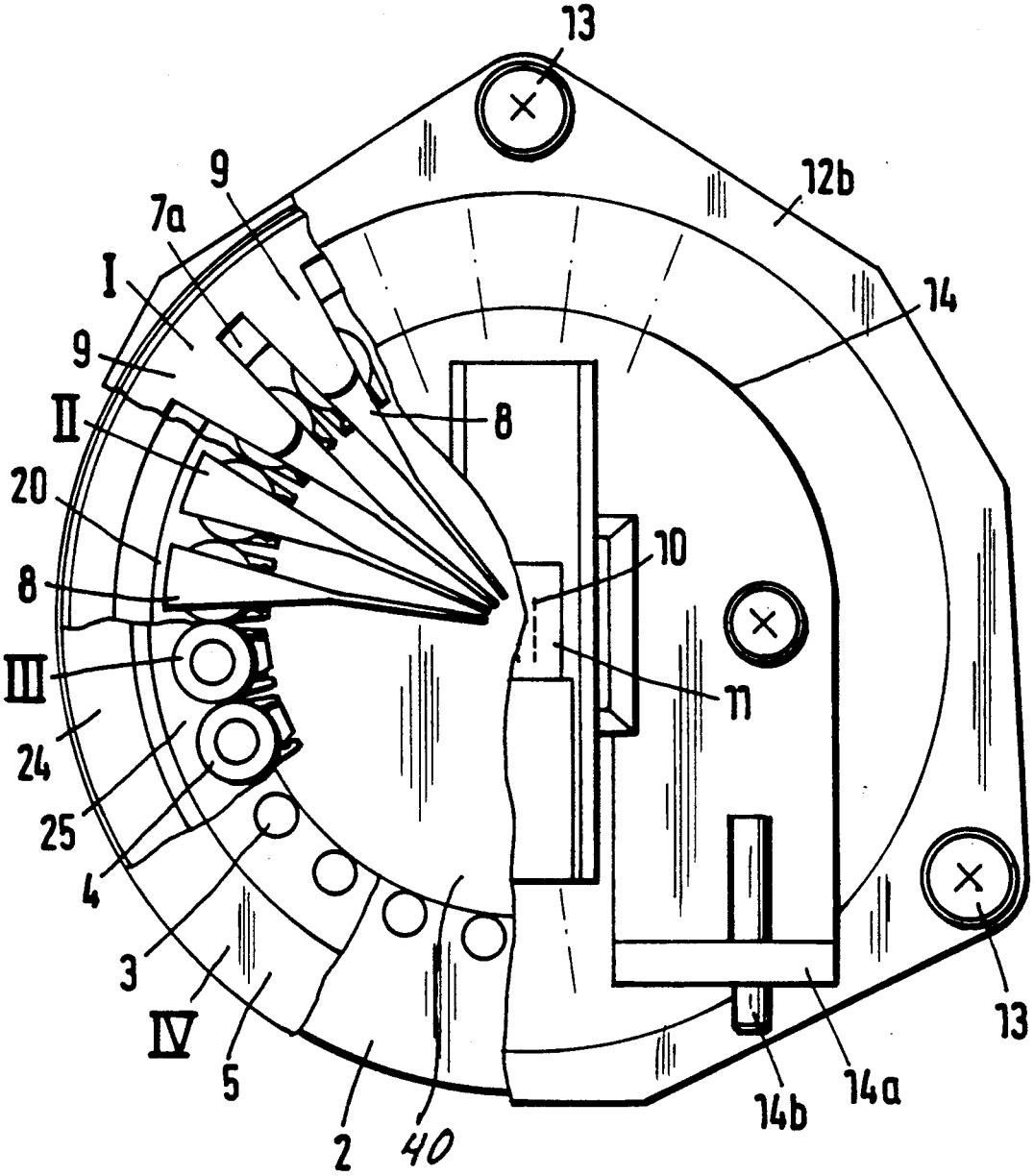
FIG. 2 is a composite elevation and section view of assembly sectors taken in different planes as indicated by I,II,III,IV in FIG. 1.

An intermediate plate 24 is arranged between the magnetic yoke plate 2 and the armature 7. This plate 24 has a front side 24*a* and establishes a common plane 25 as shown particularly in FIG. 2 whereby the armature ring 7 with interconnected housing or casing parts 12*a* and 12*b* in fact are situated in that plane 25 and bear against the intermediate plane 24.

The armature arms 8 when retracted in FIG. 1 are slightly obliquely arranged vis-a-vis the plane 25 and abut on the respective magnetic core 3. This is the case when no current flows in the coil 4 and the core is magnetized by the permanent magnet. The thickness of the armature ring 7 is made to correspond to the thickness of the armature arms 8 including the relatively thin dimensions of the spring arms 9 by means of which the armature arms 8 are connected to the armature ring 7. The very short spring arms 9 are provided with a relatively short clamping length which is permissible on account of the step 7*a* and only a remaining armature ring surface 7*b* is available for connection to the arms. The step 7*a* enhances freedom of bending movement of the arms 8. The step 7*a* may in fact constitute a continuation of the air gap 20. Alternatively it is possible to provide the relatively short spring arms 9 from an antimagnetic material such as a Cr-Ni steel so that in fact no magnetic flux lines run through the spring arms nor in the vicinity of the step 7*a*. Another limitation of the stray flux is carried out through the particular yoke and return path plate 2 which is of ring shape configuration and the inner boundary ends adjacent to the surface portions of core 3 which face radially the print elements 10.

Figure 3:
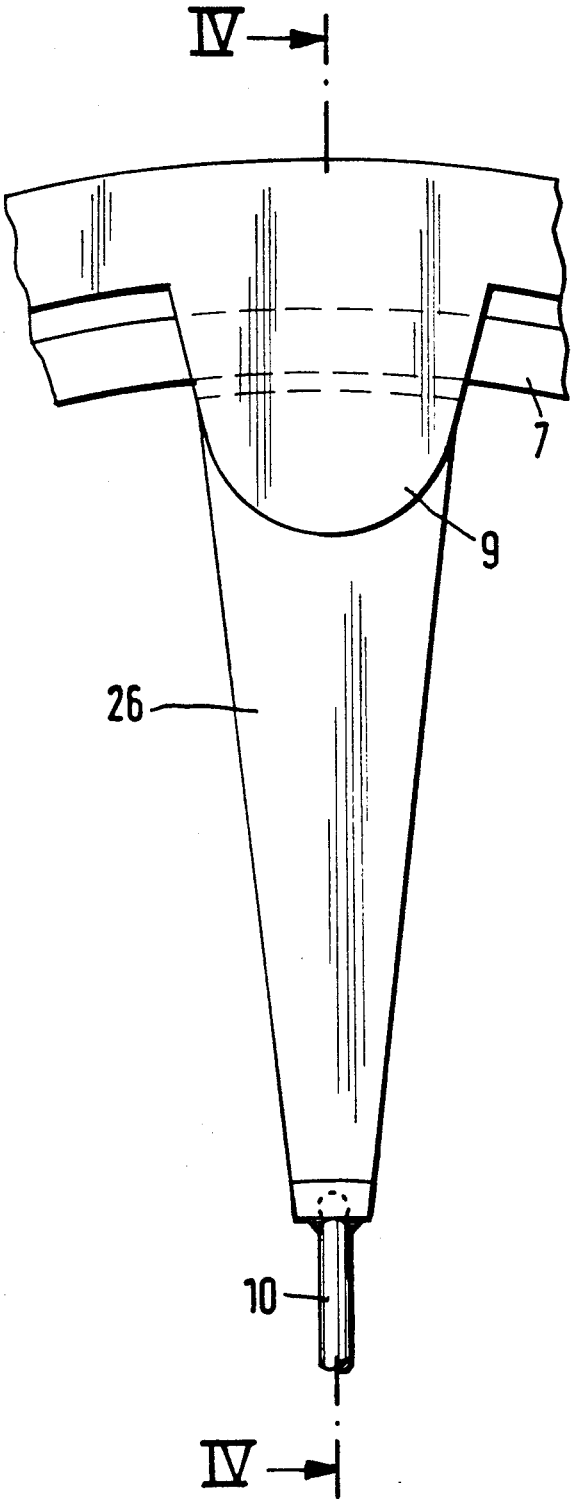
Fig. 3 PRIOR ART
FIG. 3 is a front view of a print needle or stylus fastening point in accordance with the prior art.
Figure 4:
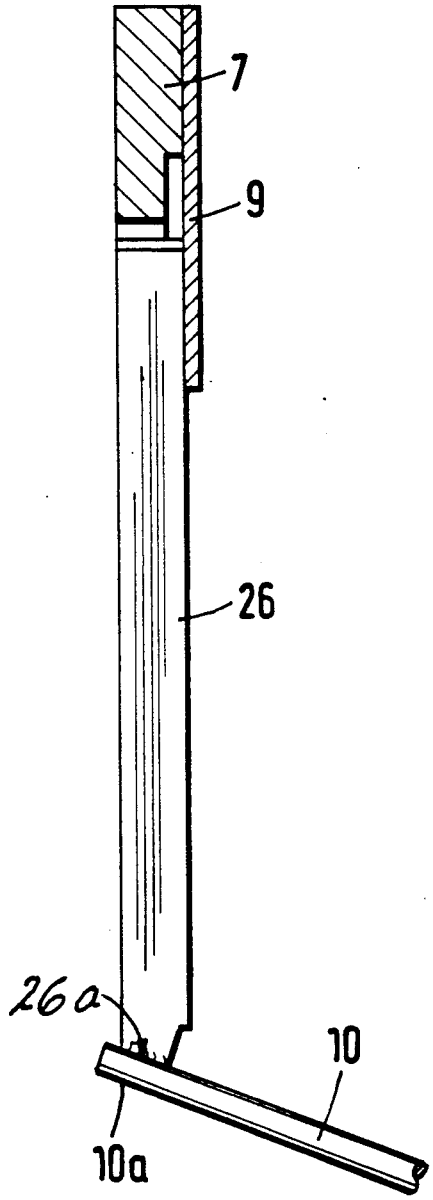
Fig. 4 PRIOR ART
FIG. 4 is a central section view as indicated by IV—IV in FIG. 3.

The state of the art of fastening styli to an armature is depicted in FIG. 3 and 4 though the upper parts of these Figures are not state of the art. There are shown print needles with magnetic drive elements 26 corresponding functionally but not structurally to the armature arms 8. These print needles are fastened directly with their respective periphery 10*a* by means of solder 26*a*. As was outlined in the introduction this fastening is disadvantaged for a variety of reasons.

Figure 5:
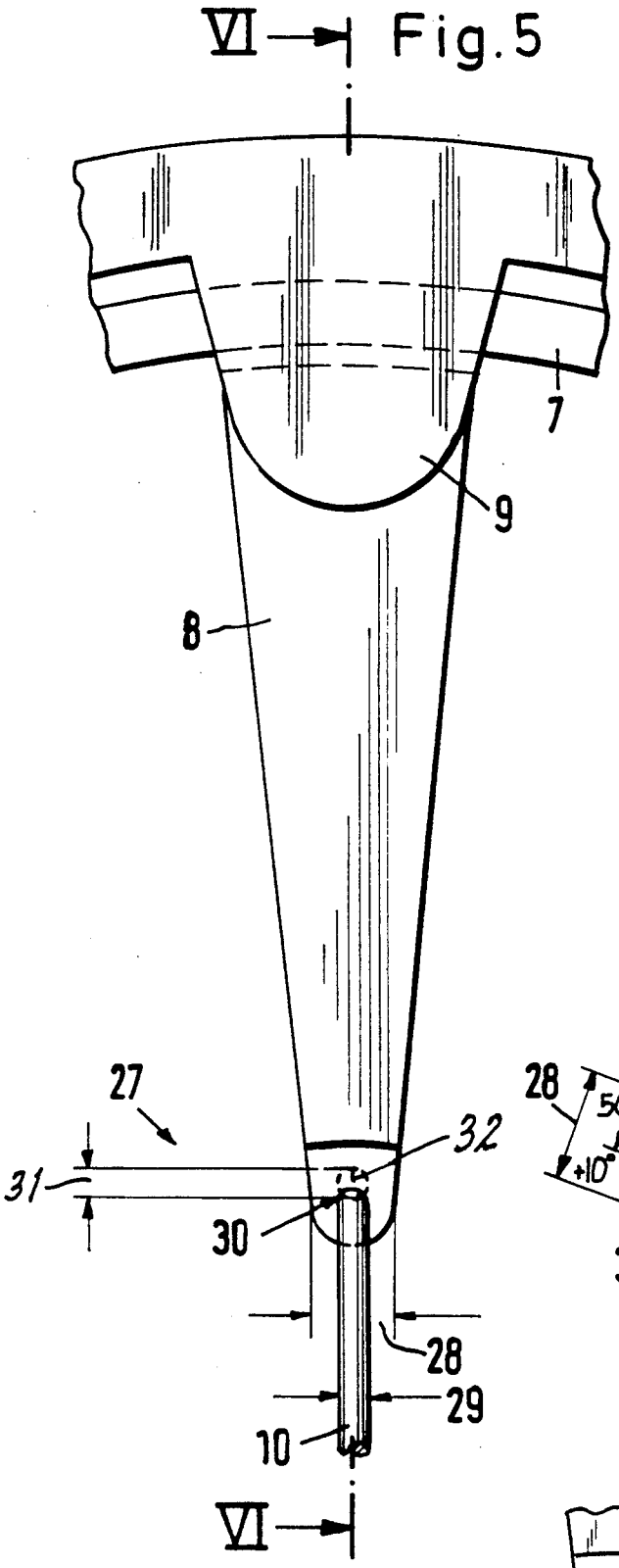
FIG. 5 is a front view comparable with FIG. 3 as far as overall illustration is concerned, but showing the inventive fastening of a print needle to a magnetic drive elements.
Figure 6:
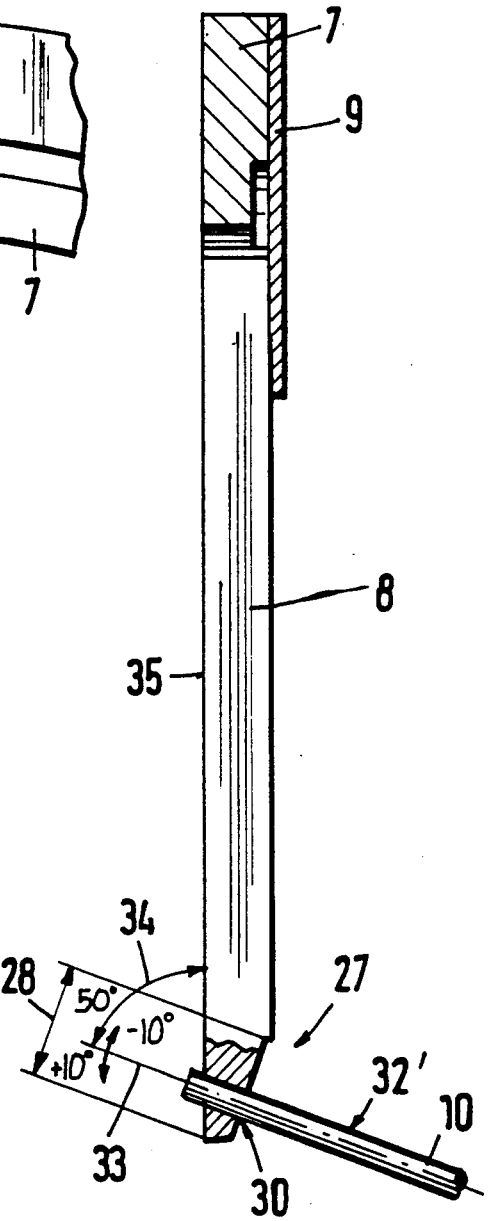
FIG. 6 is a section as indicated by VI—VI in FIG. 5.

As far as the invention is concerned the particular fastening is depicted in FIG. 5 and 6. Herein a magnetic drive element such as armature 8 which tapers i.e. narrows in width to radial inward direction having a fastening area 27 and a width dimensions 28 thereof which is at least twice the thickness 29 (diameter) of the respective print needle, stylus or wire 10. In the middle of the fastening area 27 there is provided an opening 30 having a particular cross section which is either a circle, a rectangle or a square. In either case, the cross section matches the cross section of the needle 10 under consideration of the respective manufacturing tolerance. The particular opening 30 is circular with diameter 31 because the needle has a circular cross section, the opening would be square shaped if indeed the needle is square shaped; rectangularity being used accordingly. In each case certain tolerances have to be observed. The basic cross section as defined in this fashion is realized at least in a portion of the periphery 32 so that the needle 10 (periphery 32') can indeed by inserted and firmly positioned therein. In the particular example the opening 30 is drilled as a circular bore being at least 0.2 mm wide but not more than 0.4 mm whereby in the latter case a needle with a circular cross section and having a diameter of 0.36 mm can easily be inserted. The residual gap is now filled with solder material. The axis 33 of the needle being coaxial with the central axis of the opening 30 extends at an angle 34 to the surface 35 of the magnetic drive element 8. As can be seen from the lower portion of FIG. 6, the specific case illustrated shows the angle 34 between the surface 35 and the axis 33 to be about 50° which is about 40° to a normal on surface 35. The range of interest for the angle covers between +10° and −10° with reference to the 50° angle 34.

Figure 7:
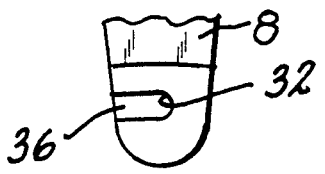
FIG. 7 is a view similar to the lower part of FIG. 5 but showing a modification.

An alternative realization of fastening is shown in FIG. 7. The opening 30 here is additionally configured to have a slot 36 worked laterally into drive element 8 (or from the front). The width of that slot corresponds to the thickness dimension 29 of the needle 10. This means that the needle can be laterally shifted into this opening 36 or from the front). Subsequently i.e. after needle 10 has been inserted into slot 36, that slot will be closed by means of solder brazing material. This alternative mode of fastening ensures also an accurate position by abutment of the needle with a portion of periphery 32' against the walls 32 of opening 30.

The invention is not limited to the embodiments described above but all changes and modifications thereof, not constituting departures from the spirit and scope of the invention, are intended to be included.

I claim:

1. In a matrix printhead having a plurality of electromagnetic drives arranged in an annular cluster around an axis including an annular support for fastening a plurality of radially inwardly extending drive elements further having a plurality of reciprocating print needles moving generally in a direction of the axis, a fastening structure for each of these needles to a radial inward end of the respective drive element comprising:

said radially extending drive elements each tapering from a wide area of fastening the respective element to the annular support toward a radially inward extending, narrow part, said narrow part being wider in an area of needle fastening than a thickness dimension for the print needle;

a drilled bore centrally disposed in the needle fastening area of the drive element, the bore having a cross sectional contour which matches at least in parts the contour of the periphery of the needle to be inserted but being larger than said thickness dimension of the needle, the bore having a central straight axis which extends obliquely to a surface of the drive elements at an angle of about 50°, +10° or −10°, said surface extending in radial direction of the respective drive element; and and solder positioned between the needle as inserted in said bore and said bore itself said solder being within a clearance space between the inserted needle and the bore.

2. The fastening as in claim 1 wherein an additional lateral slot means are provided for insertion of the needle into said opening.

* * * * *